US006609558B1

(12) United States Patent
Charbonnelle

(10) Patent No.: US 6,609,558 B1
(45) Date of Patent: Aug. 26, 2003

(54) DEVICE FOR FIXING A FIRST HEAT EXCHANGER CONDUIT ON A SECOND HEAT EXCHANGER FLUID BOX

(75) Inventor: François Charbonnelle, Orsay (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/367,172

(22) PCT Filed: Dec. 9, 1998

(86) PCT No.: PCT/FR98/02673

§ 371 (c)(1),
(2), (4) Date: Aug. 9, 1999

(87) PCT Pub. No.: WO99/30097

PCT Pub. Date: Jun. 17, 1999

(30) Foreign Application Priority Data

Dec. 10, 1997 (FR) ..... 97 15637

(51) Int. Cl.[7] ..... F28F 9/00; F28D 1/00; B60K 11/04

(52) U.S. Cl. ..... 165/67; 165/149; 180/684

(58) Field of Search ..... 165/67, 149, 140; 180/68.4

(56) References Cited

U.S. PATENT DOCUMENTS 3,833,054 A * 9/1974 Gross et al. ..... 165/67
4,997,033 A * 3/1991 Ghiani et al. ..... 165/67
5,127,466 A * 7/1992 Ando ..... 165/67
5,429,182 A * 7/1995 Hanafusa ..... 165/67
5,441,100 A * 8/1995 Ueda et al. ..... 165/149
5,456,089 A * 10/1995 O'brien ..... 165/149
5,570,737 A * 11/1996 Tokutake ..... 165/67
5,657,817 A * 8/1997 Heine et al. ..... 165/67
5,697,431 A * 12/1997 Nagasaka ..... 165/149

FOREIGN PATENT DOCUMENTS

JP 404353396 * 12/1992 ..... 165/67
JP 405045087 * 2/1993 ..... 165/67
JP 405087483 * 4/1993 ..... 165/67
JP 08327186 A * 12/1996

* cited by examiner

*Primary Examiner*—Henry Bennett
*Assistant Examiner*—Tho Duong
(74) *Attorney, Agent, or Firm*—Morgan & Finnegan, LLP

(57) ABSTRACT

The invention concerns a device for fixing a first heat exchanger conduit on a second heat exchanger fluid box, in particular for a motor vehicle, comprising at least one fixing bracket moulded in one single piece with a wall of the fluid box, said fixing bracket comprising an open part for receiving the conduit. In another embodiment, the fixing bracket is made integral the with conduit by welding and is fixed removable on the fluid box.

19 Claims, 3 Drawing Sheets

DEVICE FOR FIXING A FIRST HEAT EXCHANGER CONDUIT ON A SECOND HEAT EXCHANGER FLUID BOX

BACKGROUND OF THE INVENTION

The invention concerns a device for fixing a first heat exchanger conduit on a second heat exchanger fluid reservoir, in particular for a motor vehicle.

Devices of this sort are already known, which are used, for example, for fixing an air conditioning condenser conduit on a motor vehicle engine cooling radiator fluid reservoir.

In such an application, the two heat exchangers are disposed in proximity to one another, so that one and the same air flow successively passes across the condenser body and the radiator body.

The condenser has passing through it a cooling or refrigerating fluid which enters in the vapour phase and emerges therefrom in the liquid phase after condensation by exchanging heat with the air flow.

In addition, the cooling radiator has passing through it a liquid used for cooling the engine, this liquid entering the radiator at high temperature and emerging therefrom at a lower temperature, after exchanging heat with the air flow.

Usually, the condenser is fixed on the cooling radiator, for example by appropriate fittings formed on the fluid reservoirs situated at the two ends of the radiator body.

The condenser has two conduits used respectively for the introduction and the evacuation of the cooling fluid.

Generally, provision is made to fix-at least one of these conduits on a fluid reservoir of the radiator by appropriate fixing means.

Until now this fixing has been accomplished with collars which are placed around the conduit and then fixed to the fluid reservoir by means of a screw which passes through the collar and engages in a blind hole made in a wall of the fluid reservoir.

However, this solution is not satisfactory since it requires a number of operations which are tricky and difficult to implement, notably on automated motor vehicle assembly lines.

Moreover there is always a risk of a collar being lost during assembly operations.

BRIEF SUMMARY OF THE INVENTION

The aim of the invention is notably to overcome the aforementioned drawbacks.

To that end, the invention proposes a fixing device, which has at least one fixing bracket formed integral with one of the conduit and the fluid reservoir and suitable for being fixed in a detachable manner on the other of the conduit and the fluid reservoir.

Thus, instead of using a collar added subsequently on to the fluid reservoir, at least one fixing bracket already formed integral with the conduit or with the fluid reservoir is utilized.

This results in not only a simplified assembly, but also eliminates any risk of loss of the fixing bracket.

In a first embodiment of the invention, the fixing bracket is moulded in one single piece with a wall of the fluid reservoir. This fixing bracket has an open part suitable for receiving the conduit.

Thus, assembly is simply accomplished by inserting the conduit into the open part of the fixing bracket. This fixing is performed quickly, without requiring any special tools.

Preferably, the open part of the fixing bracket has substantially a 'C' shape in order to allow force fitting of the conduit.

As a result, the this open part exerts a clamping action on the conduit, preventing it leaving the housing defined in the open part of the fixing bracket.

Advantageously, the open part of the fixing bracket has substantially the form of a cylindrical sleeve having a longitudinal opening.

The open part of the fixing bracket is advantageously connected to the wall of the fluid reservoir by two spaced wings.

This configuration allows easy moulding and removal from the mould by appropriate moulding techniques.

According to another characteristic of the invention, the fixing bracket is attached to a prominent region of the wall.

Advantageously, the fluid reservoir and the fixing bracket are moulded in one single piece from a thermoplastic material.

In another embodiment of the invention, the fixing bracket is welded to the conduit and may be fixed to a wall of the fluid reservoir by means of a fixing screw.

Thus the fixing of the bracket is performed simply with the help of a screw, with no risk of loss of the bracket on account of the bracket being integral with the conduit.

According to an advantageous characteristic of the invention, the fixing bracket has a first end welded to the conduit and a second end provided with a hole for the fixing screw to pass through.

Preferably, the first end has substantially a C shape adapted to the shape of the conduit and the second end is a continuation laterally of the C-shaped part.

The wall of the fluid reservoir is advantageously provided with a blind hole for receiving the fixing screw.

Advantageously, the wall forms part of a projection of the fluid reservoir.

In a preferential application of the invention, the conduit is intended to have a cooling fluid passing through it.

Thus, the first heat exchanger may be a condenser forming part of an air conditioning system, and the second heat exchanger a cooling radiator for an engine, in particular of a motor vehicle.

BRIEF DESCRIPTION OF THE DRAWINGS

In the following description, given solely by way of an example, reference is made to the accompanying drawings, in which.

DETAILED DESCRIPTION OF THE INVENTION

Figure 1:
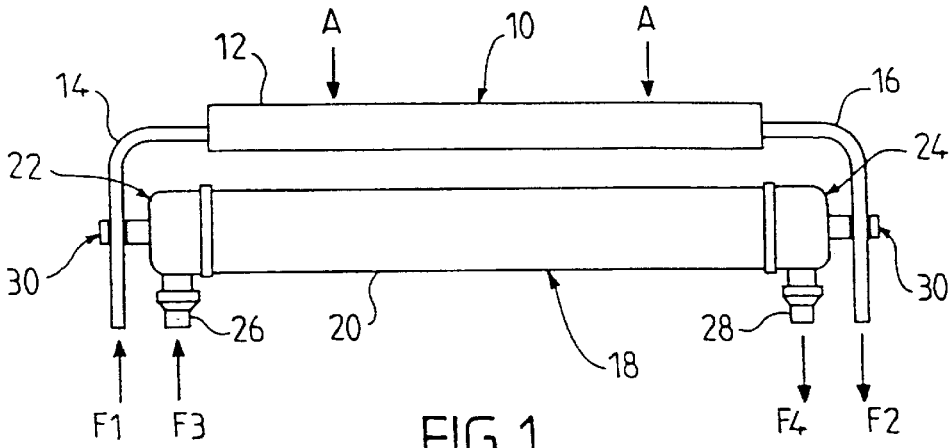
FIG. 1 is a schematic top view of a fixing device according to the invention, applied to the fixing of a condenser conduit on a fluid reservoir of a cooling radiator.

Reference is made first to FIG. 1 which depicts a condenser 10 suitable for forming part of an air conditioning system (not depicted) of a motor vehicle. The condenser 10 has a body 12 to which are connected two conduits 14 and 16 used respectively for the admission and the evacuation of a cooling fluid, as represented respectively by the arrows F1 and F2.

The condenser 10 is disposed in proximity to a radiator 18 used for cooling the engine of the motor vehicle. This radiator has a body 20 which is disposed parallel to and facing the body 12 of the condenser 10. As a result, a single air flow, as represented by the arrows A, can successively pass across the body 12 of the condenser 10 and the body 20 of the radiator 18.

The radiator 18 has two fluid reservoirs 22, 24, also referred to as "collecting reservoirs", provided respectively with two pipes 26, 28 used respectively for the admission and the evacuation of a cooling fluid, as represented by the arrows F3 and F4. This cooling fluid is usually a cooling liquid which passes through the engine of the motor vehicle.

The fluid reservoirs 22 and 24 have appropriate fittings (not depicted) to allow the fixing of the condenser 10, in a manner known to those skilled in the art of the invention.

Figure 2:
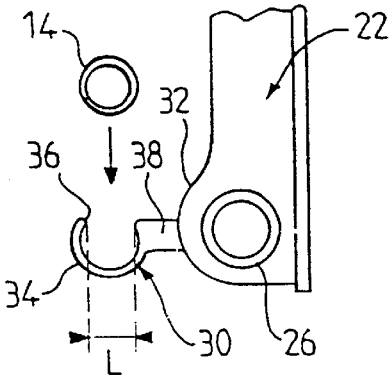
FIG. 2 is a partial side view of a fluid reservoir and a fixing device according to a first embodiment of the invention, before installation of the conduit.

The conduit 14 is fixed to the collecting reservoir 22 by a fixing bracket 30 which will be described more particularly with reference to FIGS. 2 and 3.

The fixing bracket 30 is moulded in a single piece at a prominent region of a wall 32 of the fluid reservoir 22. The fluid reservoir and the fixing bracket are advantageously moulded in a single piece from a thermoplastic material, in particular from a polypropylene type material.

The fixing bracket 30 comprises an open part 34 which has, in transverse section, substantially a 'C' shape (FIG. 2) in order to allow force fitting of the conduit 14. This open part 34 has a longitudinal opening 36 whose width L (FIG. 2) is slightly less than the external diameter of the conduit 14. As a result insertion of the conduit 14 into the open part 34 is performed with deformation of the latter in order to allow widening of the opening 36. Then, when the conduit has been completely inserted, the opening 36 narrows again, which allows the conduit to be held inside the open part 34.

The open part 34 has substantially the form of a cylindrical sleeve in which the longitudinal opening 36 is made.

Figure 3:
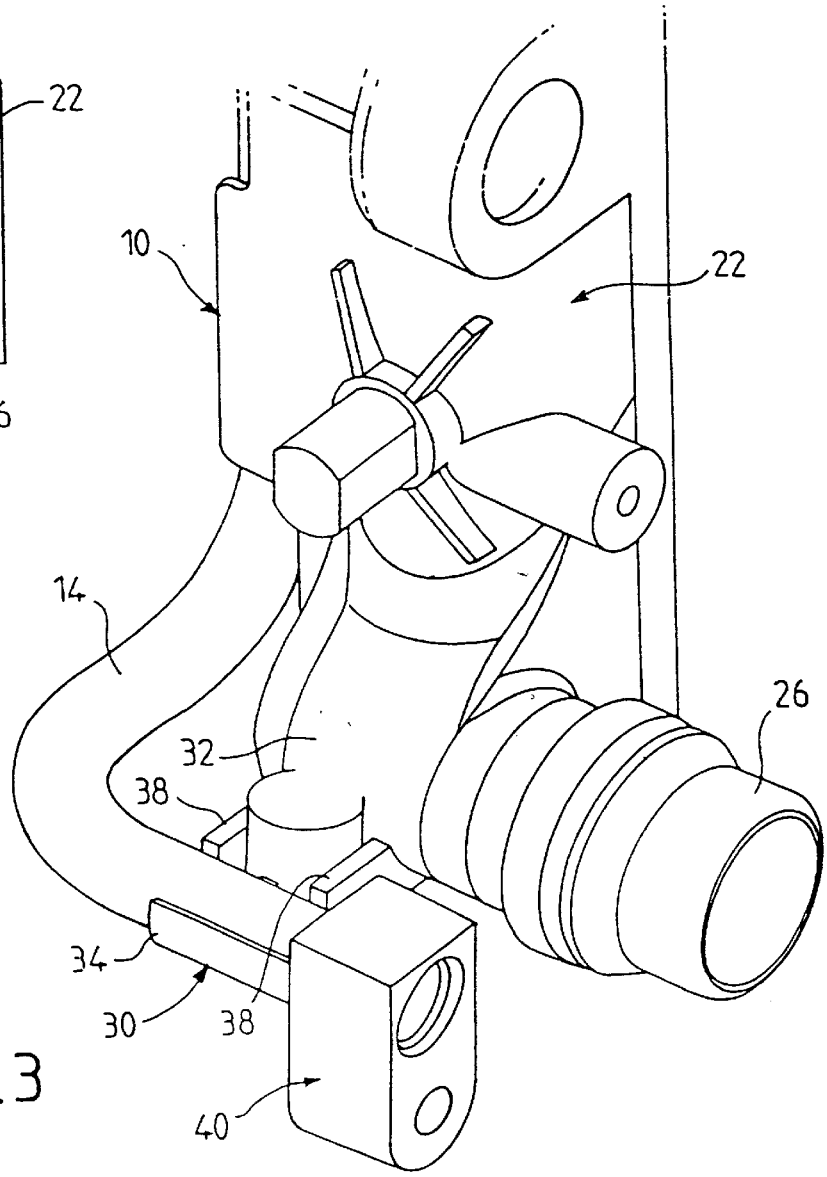
FIG. 3 is a partial perspective view of the fluid reservoir equipped with the fixing device of FIG. 2 and used for holding a conduit.

In the example depicted, the open part 34 is connected to the wall 32 of the fluid reservoir by two spaced wings 38 (FIG. 3). This configuration can be easily obtained by moulding or use of appropriate broaching tools.

The other conduit 16 of the condenser 10 is fixed to the fluid reservoir 24 by a fixing bracket 30 analogous to the preceding one, moulded in a single piece with the fluid reservoir 24. Of course, the conduits 14 and 16 could be situated on a single side of the condenser 10 and be fixed on the same fluid reservoir, for example the fluid reservoir 22, by means of two fixing brackets 30 attached to the same wall of the fluid reservoir.

As can be seen in FIG. 3, the conduit 14 ends at a connection block 40, which enables connection of the conduit 14 with other parts of the air conditioning system.

In the embodiment of FIG. 1, fixing bracket 30 is moulded in a single piece to conduit 14. The fixing bracket include a substantially C-shaped open part 34 in order to allow force fitting of a region 32 of the fluid reservoir 22. The open portion of the fixing bracket is joined to the conduit by spaced wings 38.

Figure 4:
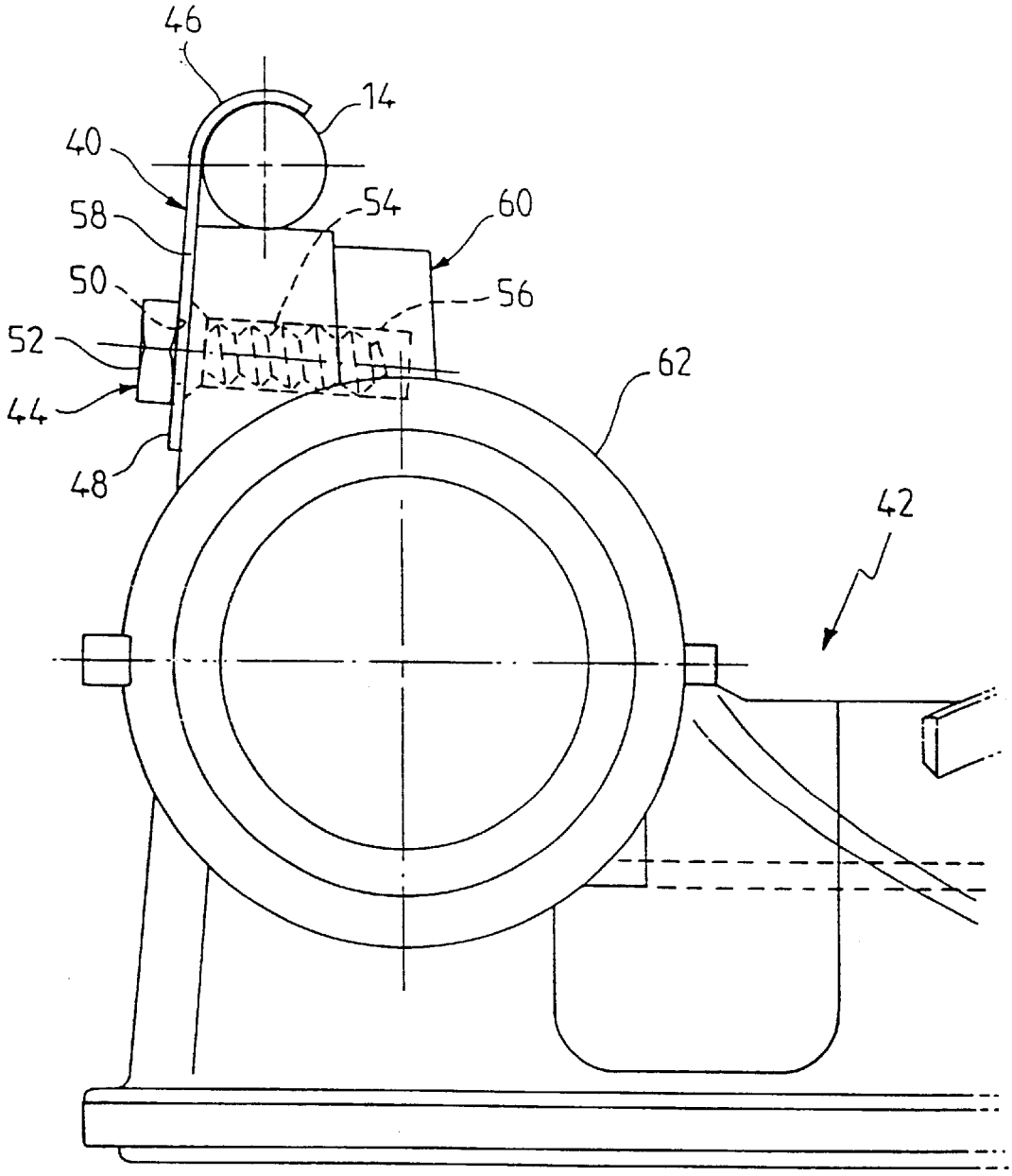
FIG. 4 is a partial elevational view of a fluid reservoir equipped with a fixing device according to a second embodiment of the invention and used for holding a conduit.
Figure 5:
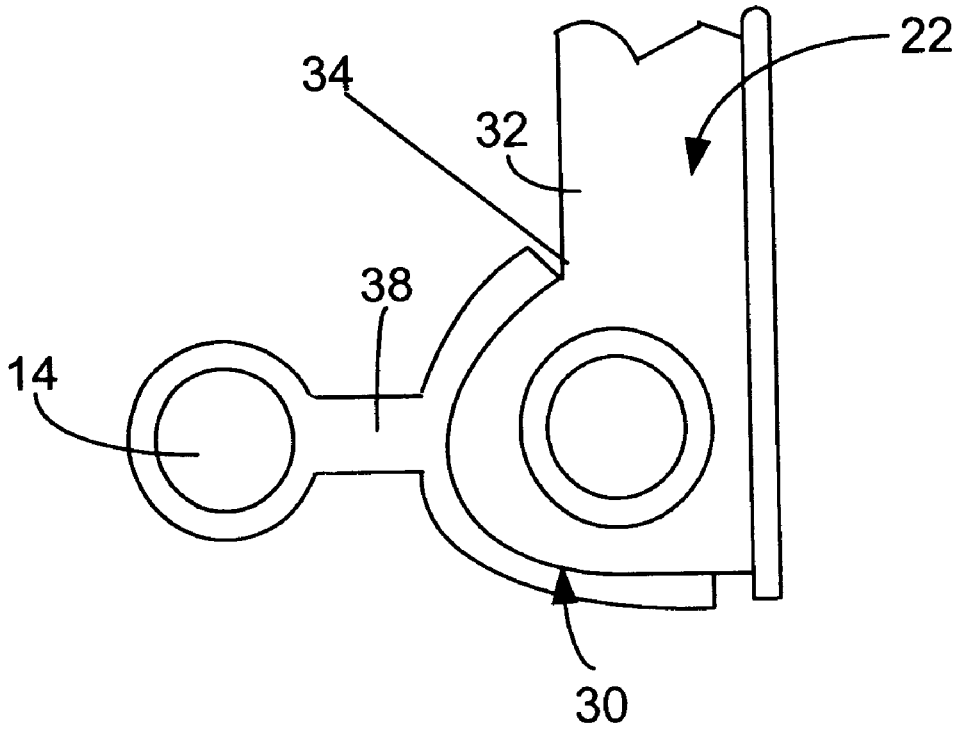
FIG. 5 is a partial side view of a conduit and a fixing device according to a third embodiment of the invention, installed on a fluid resevoir.

In the embodiment of FIG. 4, the fixing bracket 40 is welded to the conduit 14 and is fixed in a detachable manner on a fluid reservoir 42 by means of a fixing screw 44.

The fixing bracket 40 has an end 46 having substantially a C shape adapted to the shape of the conduit 14 in order to serve as a housing for the conduit. The end 46 and the conduit 14 are made integral with one another by welding or brazing and thus form an indissociable assembly avoiding any risk of loss of the fixing bracket. The fixing bracket and the conduit are advantageously both formed from a metallic material such as aluminium or an aluminium-based alloy.

The end 46 is extended laterally by an end 48 of generally flat form, which is provided with a hole 50 for the fixing screw 44 to pass through.

This screw has a head 52 coming to rest against the fixing bracket 40 and a threaded part 54 engaging in a blind hole 56 made in the fluid reservoir 42. The blind hole 56 is formed in a wall 58 forming part of a projection 60 of the fluid reservoir 42, situated close to a pipe 62 of the fluid resevoir.

Although the invention described in various illustrative embodiments, the invention intended to be is not limited to the embodiments described previously by way of examples and extends to other variants apparent to those skilled in the art in view of the foregoing description.

As already indicated, it would be possible to provide two fixing brackets in order to fix two conduits of a heat exchanger on the same fluid reservoir.

Furthermore, although the invention has been described with particular reference to fixing a condenser conduit on a cooling radiator fluid reservoir, it can be applied to other types of heat exchanger.

Thus this technique could be applied where the heat exchangers comprise a cooling radiator and a turbocharger air radiator.

What is claimed is:

1. A device for fixing a conduit of a first heat exchanger of a motor vehicle on a fluid reservoir of a second heat exchanger of the motor vehicle, the device comprising:

a first heat exchanger including a conduit, the first heat exchanger being an air conditioning system condenser;

a second heat exchanger including a fluid reservoir, the second heat exchanger being an engine cooling radiator; and a fixing bracket formed integral with one of the group consisting of the conduit and the fluid reservoir, the fixing bracket having an open part, the open part having an opening with a width slightly less than an external diameter of the other of the group, the fixing bracket fixed in a detachable manner on the other of the group.

2. A device according to claim 1, wherein the fixing bracket is molded in a single piece with a wall of the fluid reservoir, and wherein the open part receives the conduit.

3. A device according to claim 2, wherein the open part has substantially the shape of a C in order to allow force fitting of the conduit.

4. A device according claim 2, wherein the open part has substantially the form of a cylindrical sleeve having a longitudinal opening.

5. A device according to claim 2, wherein the fixing bracket further includes spaced wings connecting the open part to the wall of the fluid reservoir.

6. A device according to claim 2, wherein the fixing bracket is located in a prominent region of the wall.

7. A device according to claim 2, wherein the fluid reservoir and the fixing bracket are moulded in a single piece from a thermoplastic material.

8. A device according to claim 1, wherein the conduit has a refrigerating fluid passing therethrough.

9. A vehicle comprising the device of claim 1.

10. A device for fixing a conduit on a heat exchanger, the device comprising an air conditioning system condenser having a conduit;

an engine cooling radiator having a fluid reservoir; and a fixing bracket formed integral with one of the conduit or the fluid reservoir, the fixing bracket having an open portion with an opening that has a width slightly less than an external diameter of the other of the conduit or the fluid reservoir the other of the conduit or fluid reservoir detachably connected in the opening of the fixing bracket.

11. The device according to claim 10 wherein the fixing bracket is molded integral with a wall of the fluid reservoir and the open portion is suitable for receiving the conduit.

12. The device according to claim 11 wherein the open portion is substantially 'C' shaped to permit force fitting of the conduit.

13. The device according claim 11 wherein the open portion extends longitudinally, the opening thus extending longitudinally and the device thereby defining a substantially cylindrical sleeve for force fitting of the conduit.

14. The device according to claim 11 further comprising a wing connecting the open portion to the wall of the heat exchanger.

15. The device according to claim 11 wherein the fixing bracket is located in a prominent region of the wall.

16. The device according to claim 11 wherein the fixing bracket and a portion of the heat exchanger are moulded from a thermoplastic material.

17. The device according to claim 10 wherein a refrigerating fluid passes through the conduit.

18. A vehicle engine comprising the device of claim 10.

19. A device for fixing a conduit on a heat exchanger, the device comprising an air conditioning system condenser having a conduit;

a heat exchanger, wherein the heat exchanger is an engine cooling radiator and includes a fluid reservoir; and a fixing bracket molded integral with the fluid reservoir and detachable connected to the conduit, the fixing bracket including an open portion suitable for receiving the conduit, the open portion a substantially 'C' shaped cylindrical sleeve with a longitudinal opening, the longitudinal opening having a width slightly less than an external diameter of the conduit to permit force fitting of the conduit; and a wing connecting the open portion to the fluid reservoir.

* * * * *